US009557081B2

(12) United States Patent
Abidin et al.

(10) Patent No.: US 9,557,081 B2
(45) Date of Patent: Jan. 31, 2017

(54) APPARATUS FOR COOLING HOT CONDENSATE IN A PIPING

(71) Applicant: PETROLIAM NASIONAL BERHAD (PETRONAS), Kuala Lumpur (MY)

(72) Inventors: Mohd Fauzi Abidin, Kuala Lumpur (MY); Mohd Zurix B. Mohamed, Kuala Lumpur (MY); Mohd Fakhurrazi Mohd Salleh, Kuala Lumpur (MY)

(73) Assignee: PETROLIAM NASIONAL BERHAD (PETRONAS), Kuala Lumpur (MY)

( * ) Notice: Subject to any disclaimer, the term of this patent is extended or adjusted under 35 U.S.C. 154(b) by 487 days.

(21) Appl. No.: 14/244,691

(22) Filed: Apr. 3, 2014

(65) Prior Publication Data

US 2014/0216062 A1 Aug. 7, 2014

Related U.S. Application Data

(63) Continuation of application No. 14/001,487, filed as application No. PCT/MY2012/000031 on Feb. 24, 2012, now abandoned.

(30) Foreign Application Priority Data

Feb. 25, 2011 (MY) ..... PI 2011000878

(51) Int. Cl.
*F28B 1/00* (2006.01)
*B01F 3/04* (2006.01)
*F25B 9/04* (2006.01)
*F28B 1/02* (2006.01)

(52) U.S. Cl.
CPC . *F25B 9/04* (2013.01); *B01F 3/04* (2013.01); *F28B 1/02* (2013.01)

(58) Field of Classification Search
CPC ..... F28B 1/00; F28B 1/02; B01F 3/04
USPC ..... 165/157, 163, 913
See application file for complete search history.

(56) References Cited

U.S. PATENT DOCUMENTS 4,550,687 A * 11/1985 Jacob ..... F22D 1/18 122/1 C
2009/0277618 A1* 11/2009 Farrell ..... F24D 12/02 165/110

* cited by examiner

*Primary Examiner* — Robert A Hopkins
(74) *Attorney, Agent, or Firm* — Knobbe Martens Olson & Bear LLP

(57) ABSTRACT

The present invention provides an apparatus (10) suitable for cooling hot condensate in a piping. The apparatus comprises the use of a vortex tube (103) together with liquid such as water. A container (101) is provided to hold the liquid where the vortex tube is disposed inside the container (101). A pipe coil (133) for conveying the hot condensate is provided around the tube (104). The apparatus (10) will generate mist for cooling the hot condensate in the piping.

8 Claims, 3 Drawing Sheets

APPARATUS FOR COOLING HOT CONDENSATE IN A PIPING

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD OF THE INVENTION

This invention relates generally to an apparatus for cooling hot condensate in a piping.

BACKGROUND OF THE INVENTION

The cooling apparatus according to the present invention is suitable for use in a piping system where hot condensate (hot liquid produced by condensation of steam) in the piping need to be cooled down into cold liquid. For instance, in a boiler operation, some hot condensate will be cooled down into cold liquid so that it can be used for other suitable applications. The hot condensate will be conveyed through a series of piping and brought into a point where a necessary cooling method will be used to cool down the hot condensate. The cold liquid will then be passed through an analyzer for quality check.

Practically, hot condensate is cooled down into cold liquid before entering the analyzer because temperature of the hot condensate may affect the accuracy of the analyzer. Further, cold liquid is easy to be analyzed compared to using hot liquid.

Different cooling methods can be used to cool down hot condensate in a piping. For instance, a cooling method called cooling water system (CWS) can be used to cool the hot condensate. CWS uses cold water to remove the heat from the hot condensate. Disadvantage of using CWS is that the piping that supplies the cold water may subject to clogging after a period of time. This is due to formation of scales inside the piping that will result in insufficient flow. Although some improvements have been made to the piping to minimize this problem, clogging will still happen at the upstream piping. Other disadvantage of using CWS is that repairing and servicing a clogged piping are very costly.

Another cooling method that can be used is a vortex cooler. The vortex cooler can provide cooling air suitable for cooling purposes. However to use a vortex cooler for cooling hot condensate in a piping is an expensive option because a greater amount of energy needs to be used. Since the operation of vortex cooler is dependent on pressurized air, a greater pressurized air is needed to provide a greater cooling effect to cool down the hot condensate in a piping. The other disadvantage of using a vortex cooler is that it is not efficient. This is because the pressurized air that enters the vortex cooler is not fully utilized in which some of the pressurized air will be expelled from the vortex cooler as hot air.

In view of the above disadvantages, it is an objective of the present invention to provide an alternative cooling apparatus and method that is suitable for cooling a hot condensate in a piping.

SUMMARY OF THE INVENTION

The present invention provides an alternative cooling apparatus and method for cooling hot condensate in a piping.

According to this invention, the apparatus and method for cooling hot condensate in a piping comprise the use of vortex tube together with water. The term water and air used herein are for simplicity of description and it is not restricted to these materials only. The terms are also intended to include other vaporizable liquids suitable for evaporative cooling and the gases suitable for generating vortex respectively.

The apparatus comprises a container for holding water and a vortex tube disposed inside the container. The vortex tube has a vortex core for generating a vortex and a cylinder or tube to allow a generated vortex to flow through the tube. The tube is attached to the vortex core in an upright position. The tube is provided with a plurality of openings on its sidewalls. The core is disposed at the bottom of the container. The vortex core is provided with a first inlet to allow pressurized air to enter and a second inlet to allow water from the container to enter the vortex tube. The vortex core is in communication with the water inside the container via a piping wherein the piping is connected between the second inlet of the vortex core and a first outlet provided at the container. Water level inside the container must always be above the level of the first outlet of the container so that a continuous circulation can be achieved during operation. A pipe coil is provided or formed around the vortex tube so that the hot condensate can travel longer along the vortex tube and increase surfaces for evaporative cooling.

In operation, pressurized air will be channeled into the vortex core via a first inlet where it will generate a vortex. The generation of the vortex will create a vacuum which in turn will draw the water from the container through the piping. The vortex will swirl the water and force the water upward and this will allow the water to flow through the upright tube and eventually disperses through the openings in the form of mist. Some of the droplets will be in contact with the coil and absorb latent heat from the hot condensate and evaporates into vapour leaving the hot condensate in the piping with lowered temperature. Rapid movement of the water due to the vortex results in a rapid evaporative cooling.

BRIEF DESCRIPTION OF THE DRAWINGS

This invention will be described by way of example with reference to the accompanying drawing, in which.

DETAILED DESCRIPTION OF THE INVENTION

Figure 1:
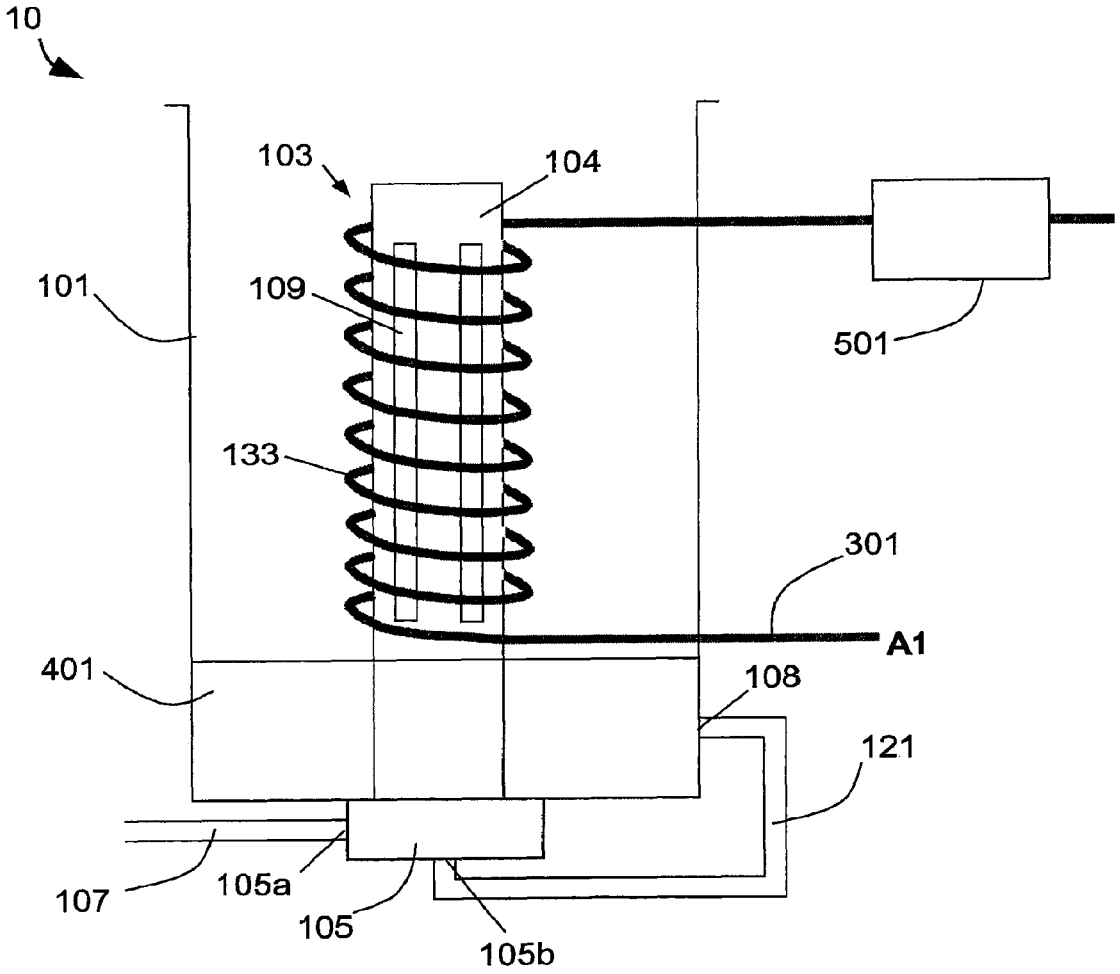
FIG. 1 shows an apparatus for cooling condensate in a piping according to an embodiment of the invention.

An apparatus (10) for cooling condensate in it piping according to an embodiment of the invention is shown in FIG. 1. The apparatus comprises a container (101) for holding water, a vortex tube (103) having a vortex core (105) and a tube (104) disposed inside the container (101), a pipe coil (133) for conveying hot condensate coiled around the tube (104), wherein the vortex core (105) has a first inlet (105*a*) to allow a pressurized air to enter the vortex tube (103) for creating vortex and a second inlet (105*b*) for allowing water from the container to enter the vortex tube (103), wherein the container (101) is in communication with the vortex tube (103) through a connecting pipe (121) which is connected between the second inlet (105*b*) of the vortex core (105) and an outlet (108) provided at the container (101), wherein the tube (104) has a plurality of openings (102) on its sidewalls to allow water following the vortex to discharge or disperse over the coil (133). The container has an opening that act as an exhaust to allow pressure in the container (101) to escape. As shown in FIG. 1, the container has an open top.

In operation, pressurized air will be channeled into the vortex tube (103) through the first inlet (105*a*) of the vortex core (105) where it will generate vortex. The generation of the vortex will generate a vacuum which in turn will draw the water from the container (101). The water inside the container (101) will travel through the connecting pipe (109) to the vortex core (105). When the water enters the second inlet (105*b*) and the water will be swirled by the vortex and forced upward. This will allow the water to flow through the upright tube (104) and eventually discharges through the openings (109) in the form of cool mist. Some droplets will be in contact with the coil (133) and absorb latent heat from the hot condensate and evaporates into vapour leaving the hot condensate in the coil (133) with lowered temperature. Rapid movement of the water due to the vortex results in a rapid evaporative cooling. As shown in FIG. 1, the hot condensate will travel from point A1 to the cooling apparatus (10) and will leave the apparatus (10) as cold liquid and will enter an analyzer (501).

Figure 2:
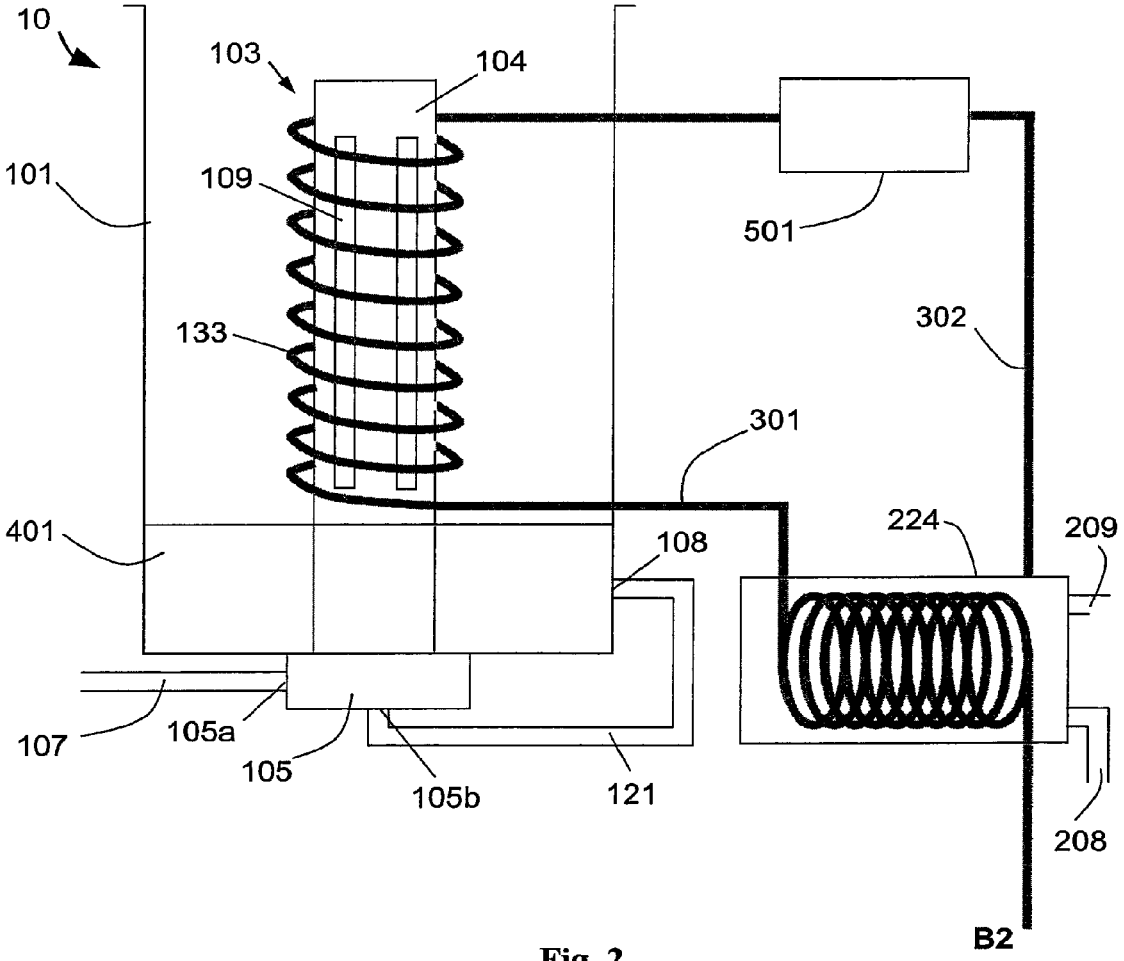
FIG. 2 shows an apparatus for cooling condensate in a piping shown in FIG. 1 in an application.
Figure 3:
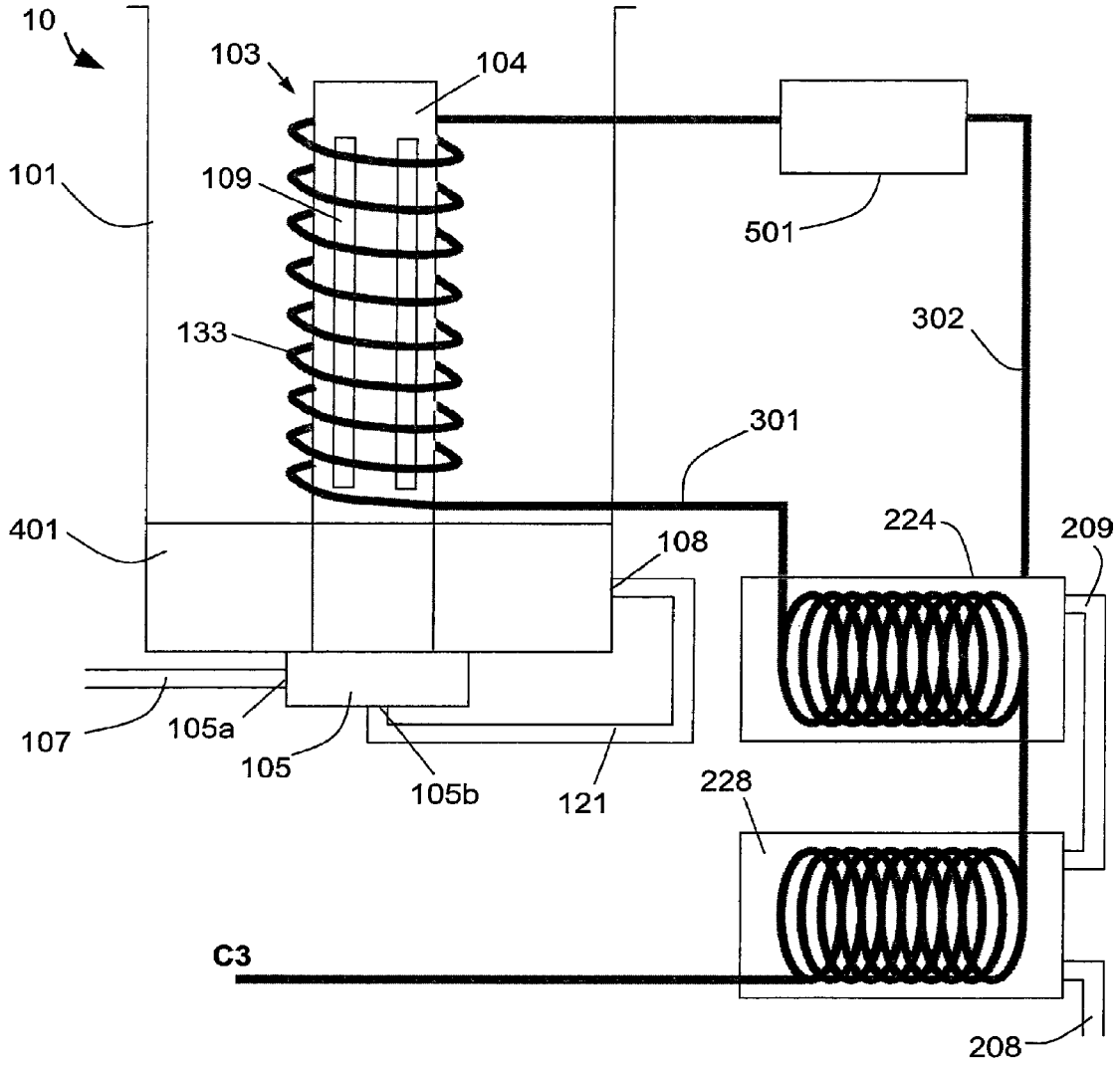
FIG. 3 shows an apparatus for cooling condensate in a piping shown in FIG. 1 in another application.

FIG. 2 shows the use of the apparatus (10) in an application. The cold liquid that passed through the analyzer (501) is channeled to a first auxiliary container (224) so that the cold liquid leaving the apparatus (10) can be used to cool down hot condensate in the piping prior to entering the cooling apparatus (10). The first auxiliary container (224) acts as a pre-cooler. As shown in FIG. 2, the hot condensate will travel from point B2 to the first pre-cooler (224) and then to the cooling apparatus (10). As shown in FIG. 3, the first pre-cooler container (224) can be connected to another auxiliary container (228) which acts as a second pre-cooler so that the cold liquid leaving the apparatus (10) can be used to cool down the hot condensate entering the piping before entering the first pre-cooler (224) and the cooling apparatus (10). As shown in FIG. 3, hot condensate will travel from point C3 to the second pre-cooler (228) and then to the first pre-cooler (224) before entering the cooling apparatus (10). A draining pipe (209) is connected between the first pre-cooler (224) and second pre-cooler (228) to allow cold liquid to flow into the second pre-cooler (228) after the first pre-cooler (224) being filled up. An outlet (208) is provided at the second pre-cooler to allow liquid or water to be discharged. It is obvious that multiple pre-coolers can be added to this system.

According to the present invention, about 7 kg 1 $cm^2$ of pressurized air is used to generate cool mist with temperature of 13° C. wherein the mist is capable of cooling hot condensate from 80° C. to 20° C. at the rate of 250 ml per minute.

What is claimed is:

1. An apparatus for cooling hot condensate in a piping comprising:

a container for holding a liquid;

a vortex tube having a vortex core for creating vortex and a tube with a plurality of openings for dispersing the liquid;

a pipe coil coiled around the tube for conveying hot condensate;

wherein the vortex draws the liquid from the container through the vortex core to allow the liquid to disperse through the openings as mist.

2. An apparatus for cooling hot condensate in a piping as claimed in claim 1 wherein the vortex core has a first inlet for allowing pressurized air to enter and a second inlet for allowing liquid from the container to enter.

3. An apparatus for cooling hot condensate in a piping as claimed in claim 1 wherein the container comprises an outlet for allowing water to flow out of the container.

4. An apparatus for cooling hot condensate in a piping as claimed in claim 3, wherein the second inlet of the vortex core is connected to the outlet of the container via a connecting pipe.

5. An apparatus for cooling hot condensate in a piping as claimed in claim 3 wherein hot condensate leaving the apparatus is cold liquid.

6. An apparatus for cooling hot condensate in a piping as claimed in claim wherein the cold liquid is channeled to a container to allow hot condensate in the piping to be cooled down before entering the apparatus.

7. An apparatus for cooling hot condensate in a piping as claimed in claim 6 wherein the cold liquid from the container is channeled to another container to allow hot condensate in the piping to be cooled down before entering the apparatus.

8. An apparatus for cooling hot condensate as claimed in claim 1, wherein the container has an open top for allowing pressure in the container to escape.

* * * * *